US006679554B2

(12) United States Patent
Anders

(10) Patent No.: US 6,679,554 B2
(45) Date of Patent: Jan. 20, 2004

(54) STAND AID

(75) Inventor: Fridolin Anders, Immendingen (DE)

(73) Assignee: Karl Storz GmbH & Co. KG (DE)

( * ) Notice: Subject to any disclaimer, the term of this patent is extended or adjusted under 35 U.S.C. 154(b) by 0 days.

(21) Appl. No.: 10/075,883

(22) Filed: Feb. 14, 2002

(65) Prior Publication Data

US 2002/0158498 A1 Oct. 31, 2002

Related U.S. Application Data

(63) Continuation of application No. PCT/EP00/07509, filed on Aug. 3, 2000.

(30) Foreign Application Priority Data

Aug. 18, 1999 (DE) ..... 199 39 128

(51) Int. Cl.[7] ..... A47C 1/02
(52) U.S. Cl. ..... 297/313
(58) Field of Search ..... 297/313, 314, 297/344.1, 337

(56) References Cited

U.S. PATENT DOCUMENTS

| | | | | |
|---|---|---|---|---|
| 596,931 A | * | 1/1898 | Yunck | |
| 4,099,697 A | * | 7/1978 | Von Schuckmann | |
| 4,738,487 A | | 4/1988 | Shalinsky et al. | 297/338 |
| 5,060,754 A | | 10/1991 | Feick | 182/82 |
| 5,085,290 A | | 2/1992 | Guirlinger | 182/77 |
| 5,590,930 A | * | 1/1997 | Glockl | |
| 5,630,648 A | * | 5/1997 | Allard et al. | |
| 5,927,797 A | | 7/1999 | Ferguson | 297/4 |

FOREIGN PATENT DOCUMENTS

| | | |
|---|---|---|
| DE | 1 787 342 | 4/1959 |
| DE | 1 829 791 | 4/1961 |
| DE | 26 42 112 | 3/1978 |
| DE | 82 06 113 | 8/1982 |

* cited by examiner

*Primary Examiner*—Milton Nelson, Jr.
(74) *Attorney, Agent, or Firm*—St. Onge Steward Johnston & Reens LLC

(57) ABSTRACT

A stand aid is provided with at least one sitting surface that is arranged on a support frame and can be adjusted between a load-free rest position and at least one sitting position in which it is subjected to the load of a user, whereby adjustment is carried out by the support frame which automatically readjusts the sitting surface back into the rest position by a resetting mechanism as soon as the load of the sitting surface is removed. The aim of the present disclosure is to provide a stand aid that takes over as much of the strain of standing as possible. To this end, the support frame is provided with a pivoting mechanism, can be anchored at a bottom and is provided with at least one support leg. The support frame rests on the support leg in the sitting position in order to receive the vertical forces and define the adjusting angle at the bottom.

11 Claims, 3 Drawing Sheets

R

S
4
8
4
1a
7
1
1a
6
1b
6
6
1c
5
2
3
5
6

STAND AID

This application is a continuation of pending International Application PCT/EP00/07509 filed Aug. 3, 2000, designating the United States and claiming priority from German Application 19939128 filed Aug. 18, 1999.

FIELD OF THE INVENTION

The invention relates to a stand aid with at least one sitting surface that is arranged on a support frame and can be adjusted between a load-free rest position and at least one sitting position in which it is subjected to the load of a user, whereby adjustment is carried out by means of the support frame which automatically readjusts the sitting surface back into the rest position by means of a resetting mechanism as soon as the load of the sitting surface is removed.

BACKGROUND OF THE INVENTION

Such stand aids are widely used to relieve the strain of standing in situations where sitting to perform work tasks, for instance at machines, in tool machining, or behind sales counters, is not possible. To allow the strain of standing to be relieved, customary stand aids now in use have a support frame on which at least one sitting surface is affixed. These stand aids, equipped with mechanical or gas-spring-supported height adjustment, can be either stationary or foldable; they generally share the disadvantage that, when not in use, they are in the way or must be put away in a separate place in order to keep the work area free for circulation.

A standard type of stand aid is known, for instance, from DE 26 42 112 A1. This known stand aid is designed as a single-leg seat, of which the swivel leg that supports the sitting surface is secured to a foot part by way of a resetting mechanism in the form of a spring device. The stand aid is unfolded by having the user sit on the sifting surface and hold it in this unfolded seat position by means of his weight. The sifting position is thus defined by the fact that the user supports himself with the legs or feet on the ground and thus restricts the adjusting angle of the pivot leg. The result is a weak working posture in the sifting position, because the sifting position has to be secured in every direction by the user. The continuous support of the stand aid in the sifting position, however, places a constant burden on the user, and consequently such a stand aid is only partially effective at relieving the strain of standing.

The aim of the invention, therefore, is to design a stand aid of the type mentioned at the outset, in such a way that it takes over as much of the strain of standing and/or sitting as possible.

The invention provides a solution to this aim which is characterized in that the support frame is provided with a pivoting mechanism, can be anchored on a bottom and is provided with at least one support leg. The support frame rests on said leg in the sifting position in order to receive the vertical forces and define the adjusting angle at the bottom.

This inventive design of the stand aid for the first time allows a stable sitting position in which the user is not required to support the entire vertical forces with his legs. While diverting the support weight to the bottom, the stand aid also serves to restrict the adjusting angle of the stand aid, resulting in a defined and thus stable sifting position. Such a stable sitting position clearly increases safety in the use and operation of the stand aid designed in accordance with this invention, because problems such as buckling the legs forward are no longer possible.

In addition this results in a stand aid that, after removal of the user's weight, returns to a rest position that takes up less space than in the sitting position. Such a stand aid is moved into position only when actually being used, so that the work area is otherwise kept free.

The bottom anchoring of the support frame in this design provides the counterweight for the pivoting support frame.

The resetting mechanism, designed to replace the stand aid when not in use back into rest position by means of the support frame, in one realization of the invention, is designed as a replacement spring connected with the support frame. Such a replacement spring has the advantage that it is designed as a spiral spring secured onto a pivot axis and thus upon pivoting of the stand aid is tensioned into the sitting position.

In an alternative embodiment, the replacement mechanism is designed as a counterweight with a pivoting connection to the sitting area, which counterweight in the sitting position of the stand aid is steered out of its end position in order to pre-tension the support frame in the direction toward the unburdened resting position. This design of the replacement mechanism as a counterweight can also take the form whereby the pivotable support frame is stored off-center so that it returns independently to the rest position in the absence of weight on the sitting surface when pivoted into sitting position.

According to another practical embodiment of the invention it is proposed that the sitting surface should be adjustable by means of the support frame between an unburdened rest position and two sitting positions.

BRIEF DESCRIPTION OF THE DRAWINGS

Additional characteristics and advantages of the invention can be seen in the following description of the related illustrations with a schematic drawing of one practical embodiment of an inventive stand aid. The illustrations are as follows.

DETAILED DESCRIPTION OF DRAWINGS

Figure 1:
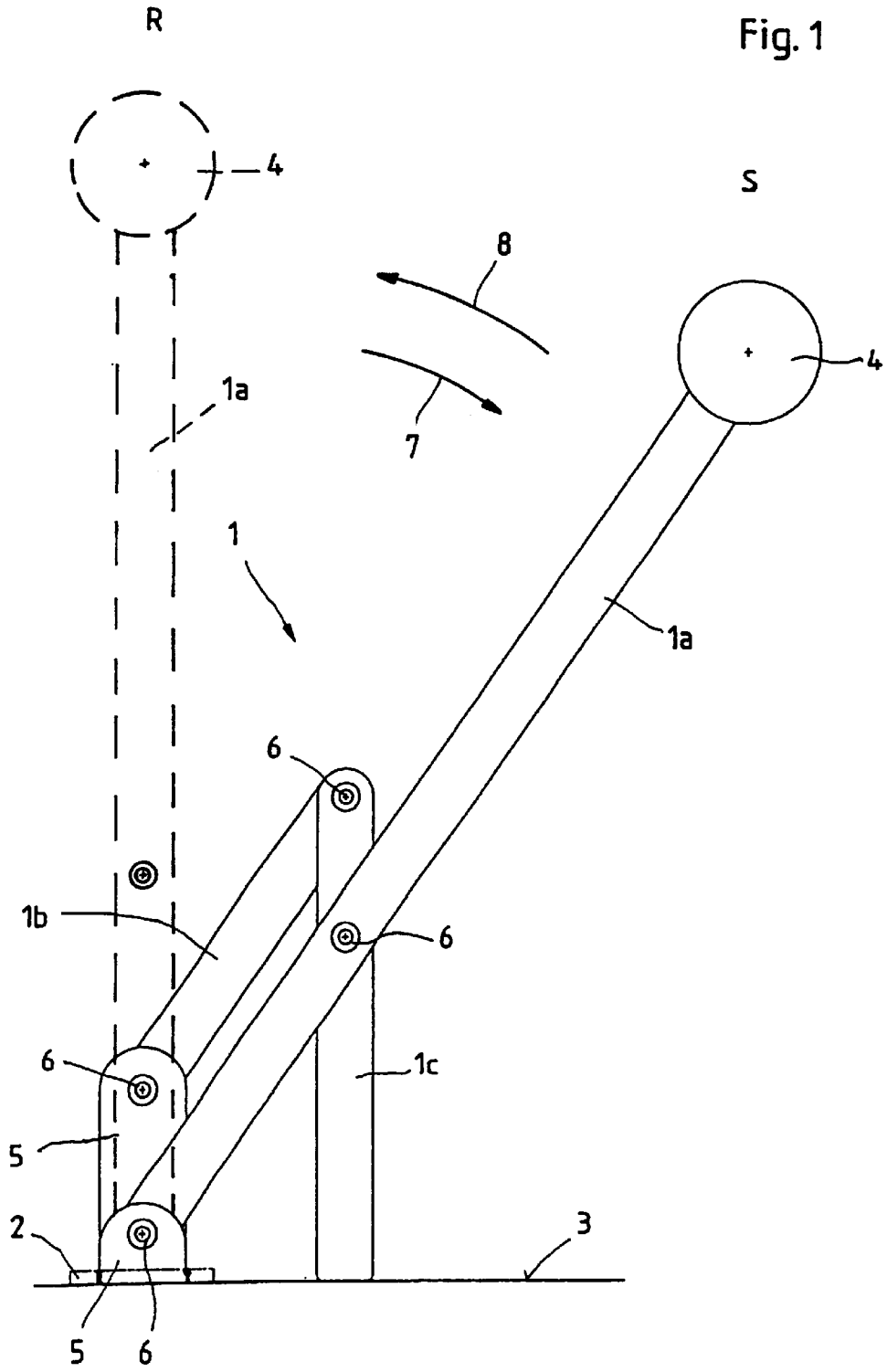
FIG. 1 Side view of a first embodiment of an inventive stand aid in the rest position and in sitting position.

The stand aid shown in FIG. 1 consists essentially of a support frame 1, which is anchored with a base 3 by means of a base plate 2, and a sitting surface 4 arranged on the upper end of the support frame 1.

Figure 2:
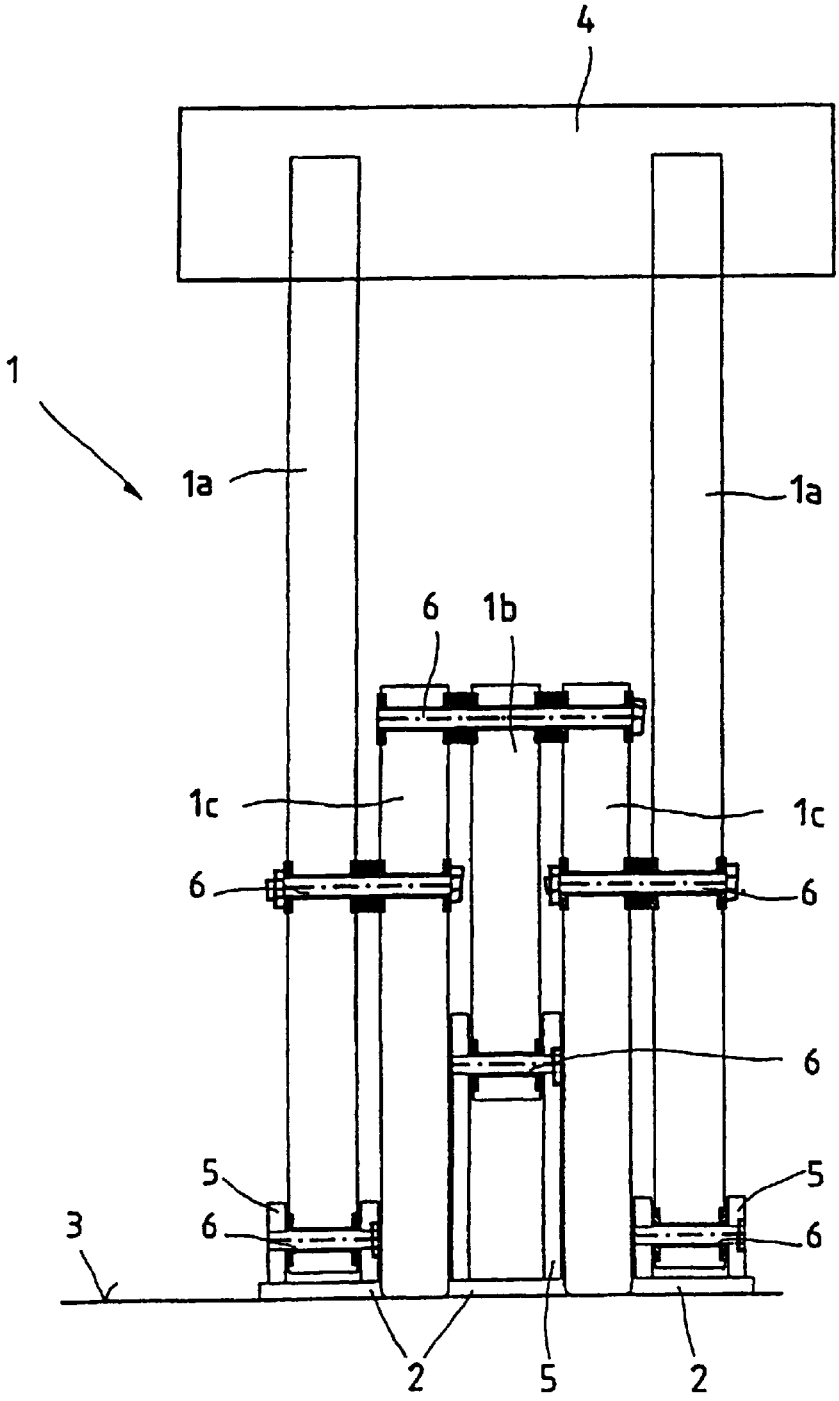
FIG. 2 Partially cutaway front view of the stand aid in accordance with FIG. 1 in the rest position.

As can be seen in FIGS. 1 and 2, the base plate 2 has three storage clamps 5, through which the braces 1*a*, 1*b* and 1*c*, which form the support frame 1, are stored on the base plate 2 to rotate around pivot axis 6. In this illustrated embodiments, the support frame 1 consists of two primary braces 1*a* stored on the external storage clamps 5 and connected with the sitting surface 4, as well as one intermediate brace 1*b* stored on the central storage clamp 5, plus two braces 1*c*, each of which connects one primary brace 1*a* with the intermediate brace 1*b* and, in sitting position S, serve as support legs 1*c* to the stand aid, which support legs restrict the rotation of the support frame 1.

Figure 3:
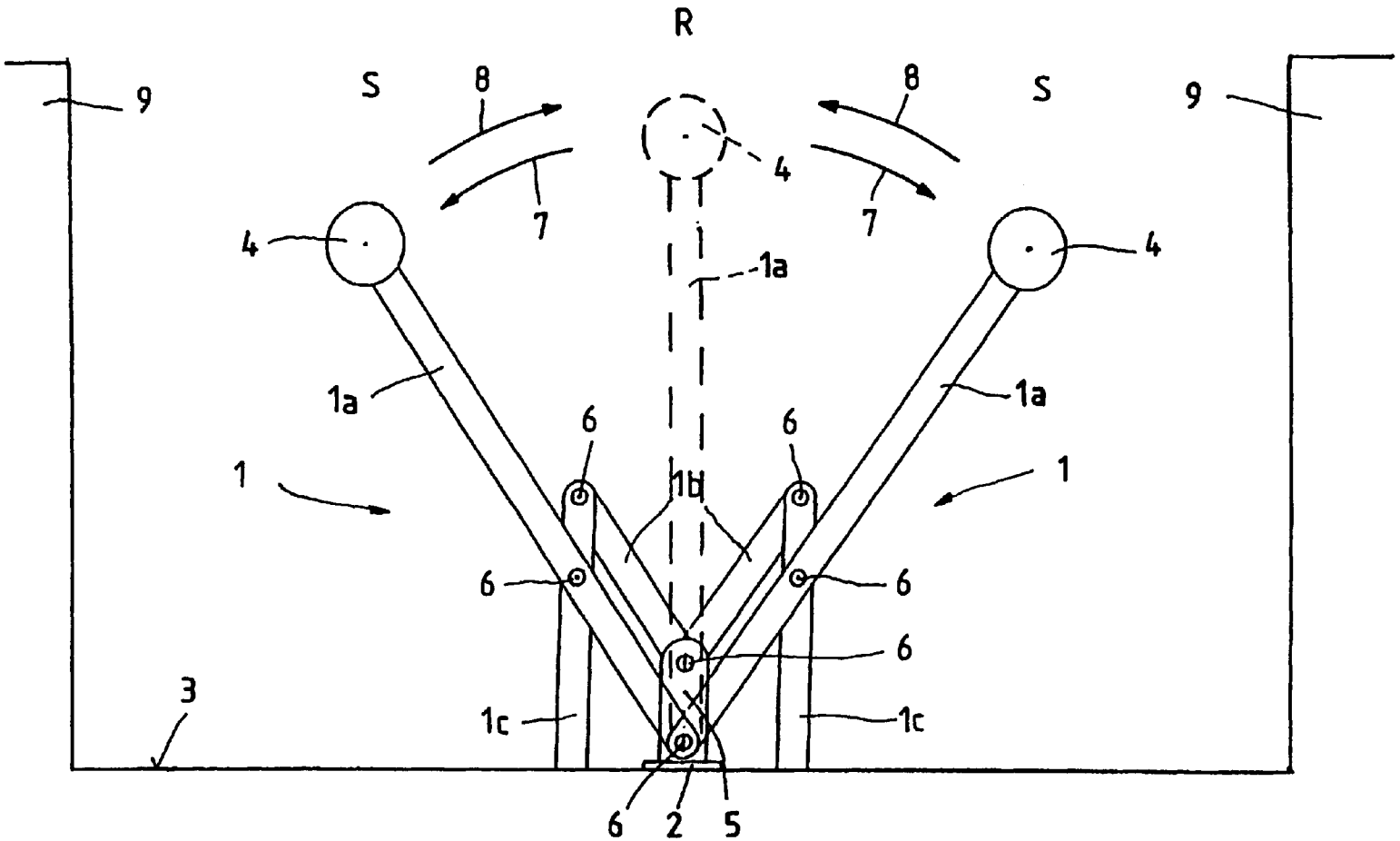
FIG. 3 Side view showing the stand aid in the rest position and two sitting positions.

FIG. 1 finally shows a stand aid that is pivotable between the rest position R, sketched with broken lines, and two sitting positions S. To move the stand aid from the rest position R into one of the sitting positions S, it is necessary only to pivot the stand aid, for instance, by means of sitting surface 4 into one of the pivoting directions designated with the arrow 7. The braces 1*a*, 1*b*, and 1*c* form the support frame 1 and follow the pivoting motion by way of the pivot axes 6, until brace 1*c* serving as support leg 1*c* stands upright on the ground 3 and thus ends the pivoting motion. Upon pivoting the stand aid from rest position R into sitting position S, a spring (not shown) is tensioned, by means of which the stand aid is pivoted automatically back into resting position R, as soon as pressure is no longer exerted on the sitting surface 4. The embodiment illustrated in FIG. 3 is particularly compact, because a stand aid is adjustable between two sitting and thus working positions on work-benches 9 for instance.

With this form of stand aid it is possible to anchor this stand aid firmly to the ground 3 outside a walking or transport pathway. If a stand aid is required, it is pivoted forward into the sitting position. As soon as the user rises from the sitting surface 4, the replacement mechanism ensures that the stand aid is pivoted back into the space-saving rest position.

| Key to Reference Numbers | |
|---|---|
| 1 | support frame |
| 1a | brace |
| 1b | brace |
| 1c | brace/support leg |
| 2 | base plate |
| 3 | ground |
| 4 | sitting surface |
| 5 | storage clamp |
| 6 | pivoting axis |
| 7 | pivot direction |
| 8 | return pivot direction |
| 9 | work bench |
| R | rest position |
| S | sitting position |

What is claimed is:

1. A stand aid with at least one sitting surface that is arranged on a support frame and can be adjusted between a load-free rest position and at least one sitting position in which it is subjected to the load of a user, whereby adjustment is carried out by means of the support frame which automatically readjusts the sitting surface back into the rest position by means of a resetting mechanism as soon as the load of the sitting surface is removed, wherein the support frame includes at least one primary brace coupled with a pivoting mechanism and anchored on a bottom, and the support frame further includes at least one support leg vertically oriented and pivotally coupled with the at least one primary brace, said support frame resting on said leg in the sitting position in order to receive the vertical load of the user without additional support by the user's own legs or an external object and define the adjusting angle of the support frame with respect to the bottom.

2. The stand aid in accordance with claim 1, wherein the resetting mechanism includes a resetting spring connected with the support frame.

3. The stand aid in accordance with claim 1, wherein the resetting mechanism includes a counterweight connected pivotally to the support frame.

4. The stand aid in accordance with claim 1, wherein the sitting surface or surfaces are adjustable between a rest position and two sitting positions by means of the support frame.

5. The stand aid in accordance with claim 1, wherein the support frame further includes at least one intermediate brace anchored on the bottom and coupled with the support leg of the support frame.

6. The stand aid in accordance with claim 5 further including at least two storage clamps for anchoring the primary brace and the intermediate brace on the bottom.

7. A stand aid for relieving the strain of standing or providing seating aid to a user, comprising:

a sitting member including a sitting surface and adjustable between a rest position and a sitting position subject to the load of the user; and a support frame including a primary brace connected to the sitting member and anchored with respect to the ground and movable between the rest position and the sitting position, the support frame further including a support leg pivotally coupled with the primary brace at an intermediate position thereof and adapted to support the load of the user even without additional support by the user's own legs or an external object when the primary brace of the support frame is in the sitting position with the support frame defining a predetermined angle with respect to the ground.

8. The stand aid in accordance with claim 7, wherein the support frame further includes an intermediate brace anchored with respect to the ground and coupled with the support leg of the support frame.

9. The stand aid in accordance with claim 7 further including at least one pivot member for anchoring the primary brace with respect to the ground.

10. The stand aid in accordance with claim 7 further including a resetting member adapted to return the sitting member from the sitting position to the rest position once the load is removed from the sitting member.

11. The stand aid in accordance with claim 10, wherein the resetting member includes a resetting spring operably connected with the support frame.

* * * * *